US007601025B1

(12) United States Patent
Phillips

(10) Patent No.: US 7,601,025 B1
(45) Date of Patent: Oct. 13, 2009

(54) CONNECTOR ASSEMBLY HAVING A JUMPER ASSEMBLY

(75) Inventor: Michael J. Phillips, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/105,419

(22) Filed: Apr. 18, 2008

(51) Int. Cl.
*H01R 13/60* (2006.01)

(52) U.S. Cl. ..... 439/541.5

(58) Field of Classification Search ..... 439/541.5, 439/607, 79, 564, 570, 573, 219; 361/756, 361/741, 760, 802
See application file for complete search history.

(56) References Cited

U.S. PATENT DOCUMENTS 4,446,505 A 5/1984 Long et al.
6,469,905 B1 10/2002 Hwang
6,511,345 B1 1/2003 Hwang
6,558,191 B2 5/2003 Bright et al.
6,729,905 B1 5/2004 Hwang
6,824,429 B2 11/2004 Hwang
2008/0242127 A1 10/2008 Murr et al.

FOREIGN PATENT DOCUMENTS

DE 296 14 726 U1 12/1996

*Primary Examiner*—Alexander Gilman

(57) ABSTRACT

A connector assembly for a device having a host circuit board includes a first circuit board, a connector receptacle and a jumper assembly. The first circuit board includes a first conductive trace. The connector receptacle is mounted on the first board and is electrically connected with the first conductive trace. The connector receptacle includes a mating interface configured to mate with an electrical connector. The jumper assembly has a height and is mounted on the first board. The jumper assembly also is electronically connected with the first conductive trace. The jumper assembly is configured to be mounted to the host board. The height of the jumper assembly controls a position of the connector receptacle with respect to the host board. The jumper assembly is configured to close a circuit comprising the first conductive trace of the first board and a second conductive trace of the host board.

20 Claims, 8 Drawing Sheets

CONNECTOR ASSEMBLY HAVING A JUMPER ASSEMBLY

BACKGROUND OF THE INVENTION

The subject matter herein generally relates to a connector assembly and, more particularly, to a jumper assembly for interconnecting circuit boards.

Many existing electrical connectors are inserted into connector cages to mate an electrical connector with a connector receptacle. For example, a small form factor pluggable (SFP or SFP+) electrical connector may be inserted into a connector cage to mate with a connector receptacle.

The connector cage and the connector receptacle are mounted on a host circuit board. The connector receptacle is mounted on the host circuit board and at least partially enclosed in the connector cage. As a result, the connector cage and the connector receptacle typically are fixed in position with respect to the host circuit board. In operation, the electrical connector is inserted into the connector cage to mate with the connector receptacle. The connector receptacle can then communicate a data or power signal between the electrical connector and the host circuit board.

Typically, the host circuit board, connector cage and connector receptacle are housed within a device. For example, the host circuit board, connector cage and connector receptacle may be contained inside a computer. A port opening on the outside of the device provides access to the connector receptacle in the connector cage. The electrical connector is inserted into the connector cage through the opening in order to mate with the connector receptacle.

Typically, the opening on the outside of the device is framed by a face plate. The size of the opening and the face plate may be fixed. For example, depending on the location of the opening and face plate on the outside of the device and the available real estate on the outside of the device, the size and dimensions of the opening and face plate may be limited.

The face plate may be mounted on or interconnected with the host circuit board. As a result, the face plate (and the opening to the device) may be fixed in location with respect to the host circuit board. Additionally, the connector cage and connector receptacle may be fixed in location with respect to the host circuit board as the connector cage and connector receptacle are mounted on the host circuit board.

The sizes and dimensions of many connector cages and connector receptacles are industry standard sizes and dimensions. For example, the sizes and dimensions of connector cages that receive SFP or SFP+ electrical connectors may be established by industry standards. Additionally, the sizes and dimensions of the connector receptacles that mate with the SFP or SFP+ electrical connectors also may be established by industry standards.

Due to the fixed locations of the face plate, the opening to the device, the connector cage and the connector receptacle with respect to the host circuit board, only certain connector cages and/or connector receptacles may be used for a given host circuit board and opening. For example, in order to align the connector cage and/or connector receptacles with the opening, only those connector cages and/or connector receptacles having particular sizes and dimensions may be mounted on the host circuit board. Other connector cages and/or connector receptacles may have sizes and dimensions that do not permit the connector cages and/or connector receptacles to properly align with the opening. For example, some connector cages and/or connector receptacles have industry standard sizes that are too large or too tall be mounted on the host circuit board while remaining aligned with the opening. If the connector cages and/or connector receptacles do not properly align with the opening, an electrical connector may not be able to be inserted into the connector cage through the opening to mate with the connector receptacle. As a result, the range of dimensions and sizes of industry standard connector cages and/or connector receptacles that may be used with a host circuit board may be limited.

Previous attempts to increase the range of connector cages and/or connector receptacles that may be used with a host circuit board have involved adding internal jogs to a connector receptacle. These internal jogs attempt to alter the alignment of the connector receptacle inside the connector cage with respect to the opening. The internal jogs are connected to a connector receptacle to alter the location and or size of the mating interface of the connector receptacle. Once an internal jog is added to a connector receptacle, an electrical connector can be mated with the jog. The creation of such internal jogs, however, can be an expensive process. Different sized and shaped jogs must be created and fabricated for many of the various sizes of connector cages and connector receptacles.

Other attempts to increase the range of connector cages and/or connector receptacles that may be used with a host circuit board have involved altering the size and dimensions of the connector cages and/or connector receptacles. For example, the sizes and dimensions of the connector cages and connector receptacles may be altered to non-standard sizes and dimensions. Changing these dimensions, however, can be an expensive process. For example, new molds, tools and/or dies used to fabricate and machine the components of the connector cages and/or connector receptacles may need to be created. These new molds, tools and/or dies may be necessary to fabricate connector cages and connector receptacles that can be mounted on a host circuit board while still be aligned with an opening or face plate connected to the host circuit board.

Thus, a need exists for an assembly that is capable of aligning a variety of connector cages and connector receptacles having different sizes and dimensions with an opening in a device that houses the connector cage and/or connector receptacle.

BRIEF DESCRIPTION OF THE INVENTION

In one embodiment, a connector assembly for a device having a host circuit board is provided. The connector assembly includes a first circuit board, a connector receptacle and a jumper assembly. The first circuit board includes a first conductive trace. The connector receptacle is mounted on the first circuit board and is electrically connected with the first conductive trace. The connector receptacle includes a mating interface configured to mate with an electrical connector. The jumper assembly has a height and is mounted on the first circuit board. The jumper assembly also is electronically connected with the first conductive trace. The jumper assembly is configured to be mounted to the host circuit board. The height of the juniper assembly controls a position of the connector receptacle with respect to the host circuit board. The jumper assembly is configured to close a circuit comprising the first conductive trace of the first circuit board and a second conductive trace of the host circuit board.

In another embodiment, a jumper assembly is provided. The jumper assembly is configured to mechanically and electrically interconnect a jumper circuit board with a host circuit board in order to align an electrical connector receptacle with a port. The electrical connector is mounted on the jumper circuit board. The port is in a faceplate mounted on the host circuit board. The jumper assembly includes a dielectric body and a plurality of contacts. The body extends between a host side and a jumper side. The body has a height between the host side and the jumper side. The contacts are held within the body. The contacts have a first side that is mechanically and electrically connected to the host circuit board. The contacts have a second side that is mechanically and electrically connected to the jumper circuit board. The body defines a separation distance between the jumper and host circuit boards. The connector receptacle is aligned with the port when the jumper and host circuit boards are separated by the separation distance.

In another embodiment, a connector assembly configured to electrically interconnect an electric connector receptacle with a host circuit board is provided. The connector assembly includes a first circuit board and a jumper assembly. The first circuit board is electrically interconnected with the host circuit board. The jumper assembly has a dielectric body that holds a plurality of electrical contacts. The jumper assembly interconnects the first and host circuit boards. The first and host circuit boards are separated by a jumper height of the jumper assembly. The connector receptacle is aligned with a faceplate mounted on the host circuit board when the first and host circuit boards are separated by the jumper height.

DETAILED DESCRIPTION OF THE INVENTION

Figure 1:
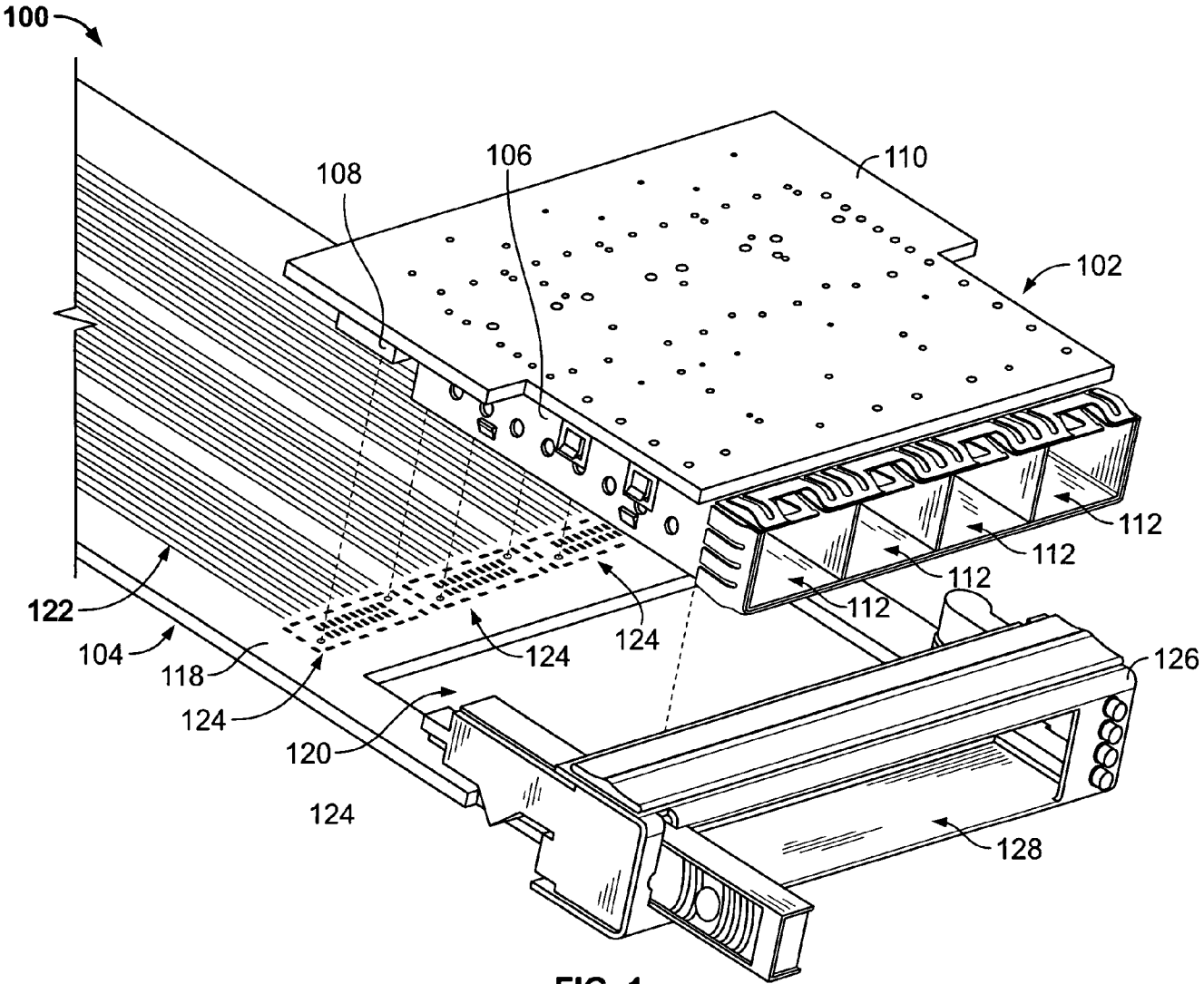
FIG. 1 is a partial exploded top view of an interconnect system according to one embodiment.

FIG. 1 is a partial exploded top view of an interconnect system 100 according to one embodiment. The interconnect system 100 includes a connector assembly 102 that is mounted onto a host interface 104. The connector assembly 102 includes a connector cage 106 and one or more jumper assemblies 108 that are mounted on a jumper board 110. The jumper board 110 is a circuit board that includes one or more conductive traces 152 (shown in FIG. 2).

The connector cage 106 includes one or more channels 112 that each receives a plug end of an electrical connector (not shown). The plug end of the electrical connector mates with a connector receptacle 114 (shown in FIG. 2). The connector receptacle 114 is located within one of the channels 112 and is mounted to the jumper board 110. Each channel 112 may include a connector receptacle 114.

The jumper assemblies 108 interconnect the connector assembly 102 and the host interface 104. The jumper assemblies 108 close a circuit that includes the connector receptacles 114, the conductive traces 152, and one or more conductive traces 122 on the host interface 104. In one embodiment, each jumper assembly 108 corresponds to one of the connector receptacles 114. In such an embodiment, each jumper assembly 108 may close a circuit that includes a corresponding connector receptacle 114, the conductive traces 152, and one or more of the conductive traces 122.

The host interface 104 includes a host board 118 and a faceplate 126 mounted to the host board 118. The host board 118 is a circuit board for a computing device. For example, the host board 118 may be a mother board for a computer. In one embodiment, the jumper and host boards 110, 118 are separate from one another. For example, the jumper board 110 does not directly connect to the host board 118.

The host board 118 includes an opening 120. The opening 120 is large enough to accept passage of the connector cage 106 through the host board 118. For example, the opening 120 may be larger than a surface area of the connector cage 106.

The host board 118 also includes the conductive traces 122. The conductive traces 122 electrically connect the connector assembly 102 with a load or device connected to the host board 118. The conductive traces 122 terminate at one or more holes or sets of holes 124 in the host board 118. One or more pins of the connector assembly 102 are inserted into the holes 124 to mount the connector assembly 102 on the host board 118.

The face plate 126 is connected to the host board 118. The face plate 126 frames a port 128. The port 128 provides an opening for access to the channels 112 through the face place 126 once the connector assembly 102 is mounted on the host board 118. The face plate 126 and the port 128 may provide access to the channels 112 from an outside portion of the device that houses the host board 118.

In operation, the connector assembly 102 is mounted on the host interface 104. The connector assembly 102 may be mounted on the host board 118 of the host interface 104 so that the jumper and host boards 110, 118 are substantially parallel to one another. Once the connector assembly 102 is mounted on the host board 118, the jumper assemblies 108 close a circuit that connects one or more of the connector receptacles 114 (shown in FIG. 2) with one or more of the conductive traces 122 in the host board 118. A plug end of an electrical connector (not shown) is inserted into one of the channels 112 through the port 128. The channel 112 guides the plug end towards the connector receptacle 114 in the channel 112. The channel 112 also may align the plug end with the connector receptacle 114. The plug end mates with the connector receptacle 114. At that point, the plug end is connected to one or more of the conductive traces 122 in the host board 118 via the circuit that includes the jumper assemblies 108. For example, the jumper assemblies 108 may electrically interconnect the connector receptacle 114 with the conductive traces 122.

Figure 2:
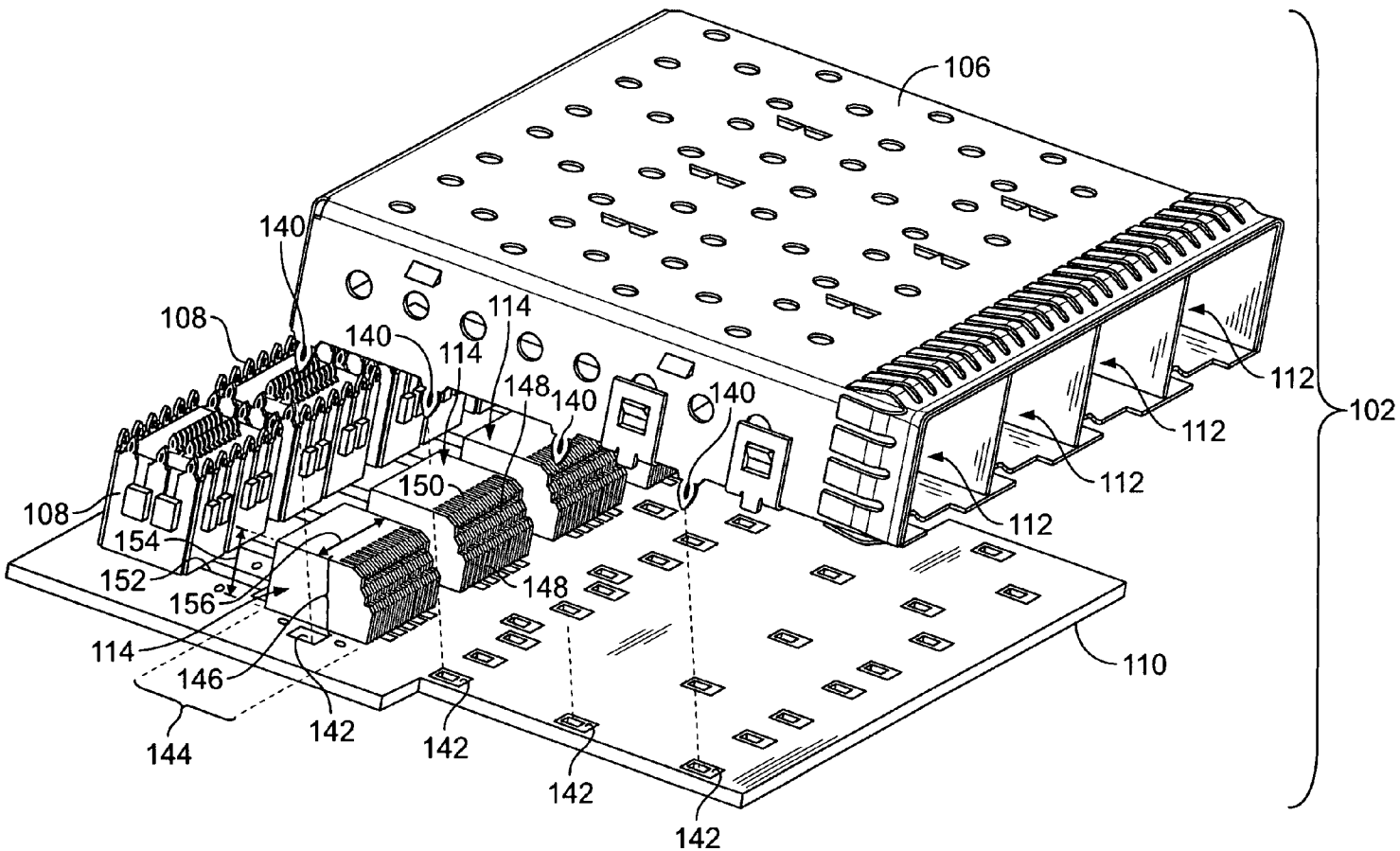
FIG. 2 is an exploded view of the connector assembly of FIG. 1.

FIG. 2 is an exploded view of the connector assembly 102. The connector cage 106 includes a plurality of retention pins 140. In the illustrated embodiment, the retention pins 140 are compliant pins that may be press fit into cage retention holes 142 in the jumper board 110. The retention pins 140 are inserted into the cage retention holes 142 to mount the connector cage 106 on the jumper board 110. In one embodiment, the connector cage 106 and the retention pins 140 are formed from or include a conductive material. The retention pins 140 may be connected to an electrical ground of the jumper board 110.

The connector cage 106 is mounted on the jumper board 110 so as to partially enclose each of the connector receptacles 114 within one or more of the channels 112. In an exemplary embodiment, once the connector cage 102 is mounted on the jumper board 110, each of the electrical receptacles 114 is partially enclosed by one of the channels 112. The channels 112 guide and align the plug end of an electrical connector to mate with the connector receptacles 114.

The connector receptacles 114 have dimensions that include a height 154 and a width 156. The height 154 is the distance that the connector receptacles 114 extend away from the jumper board 110. The height 154 also is the distance that each of the electrical receptacles 114 extends into one of the channels 112. The width 156 may be approximately the same as a channel width 158 (shown in FIG. 3) of the channels 112. Alternatively, the width 156 is less than the channel width 158.

The dimensions of the connector receptacles 114 may vary based on the type of electrical connectors and plug ends of electrical connectors that mate with the connector receptacles 114. For example, a connector receptacle 114 that is configured to mate with an SFP+ electrical connector may have a different height 154, width 156 and/or orientation than a connector receptacle 114 that is configured to mate with an electrical connector other than the SFP+ electrical connector.

Each of the connector receptacles 114 includes a mounting side 144 and a mating interface 146. In the illustrated embodiment, the mounting side 144 and the mating interface 146 are at right angles with respect to one another. Each of the connector receptacles 114 is mounted to the jumper board 110 by engaging the mounting side 144 with the jumper board 110.

The mating interface 146 mates with the plug end of an electrical connector (not shown). For example, the mating interface 146 may be configured to mate with an SFP or SFP+ electrical connector. The mating interface 146 includes electrical contacts 148 and mechanical guides 150. The electrical contacts 148 engage one or more electrical contacts of the plug end that mates with the mating interface 146. The electrical contacts 148 provide an electrical connection between the plug end of the electrical connector and the connector receptacle 114. The mechanical guides 150 guide and align the plug end of the electrical connector to properly align with the electrical contacts 148. Once the plug end of an electrical connector is mated with the connector receptacle 114, the electrical connector is electrically connected to one or more conductive traces 152 in the jumper board 110 via the connector receptacle 114.

The orientation of the mating interface 146 may vary based on the type of electrical connectors and plug ends of electrical connectors that mate with the connector receptacles 114. For example, a connector receptacle 114 that is configured to mate with an SFP+ electrical connector may have a mating interface 146 with a different orientation than that of a connector receptacle 114 that is configured to mate with an electrical connector other than the SFP+ electrical connector. For example, the electrical contacts 148 may be provided at a different distance and/or location from the jumper board 110 once the connector receptacle 114 is mounted on the jumper board 110.

One or more of the conductive traces 152 terminate to one or more electrical contacts (not shown) of the connector receptacle 114 at or in a location that is proximate to the mounting side 144. The conductive traces 152 also terminate to one or more of the jumper assemblies 108. The conductive traces 152 may be provided on the top, bottom or in internal layers of the jumper board 110. The conductive traces 152 provide conductive pathways between one or more of the jumper assemblies 108 and one or more of the connector receptacles 114. The conductive traces 152 permit communication of a data or power signal between the jumper assemblies 108 and the connector receptacles 114.

Figure 3:
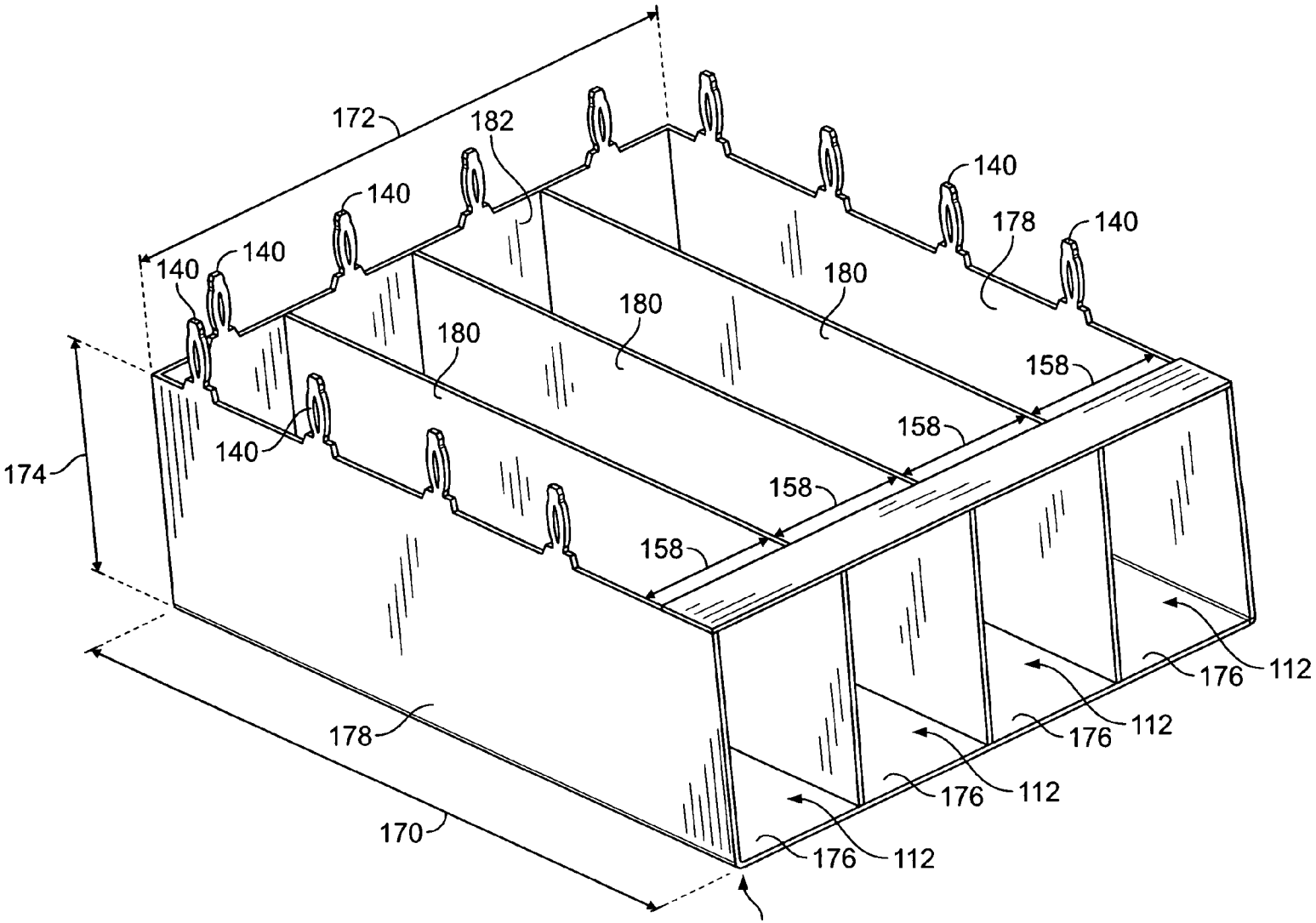
FIG. 3 is a perspective view of the connector cage of FIG. 1.

FIG. 3 is a perspective view of the connector cage 106. The connector cage 106 extends along a length 170 and a width 172. The connector cage 106 also extends away from the jumper board 110 by a height 174 when the connector cage 106 is mounted on the jumper board 110.

A top side 176 extends along the length 170 and the width 172 of the connector cage 106. A plurality of walls 178, 180 are adjacent to and extend away from the top side 176. The plurality of walls includes a pair of exterior side walls 178 and a plurality of interior channel walls 180. The exterior side walls 178 and the interior channel walls 180 may be connected to the top side 176. The exterior side walls 178 and the interior channel walls 180 may be substantially parallel to one another. The exterior side walls 178 and the interior channel walls 180 may be substantially perpendicular to the top side 176. The interior channel walls 180 are separated from one another by the channel width 158. Each of the exterior side walls 178 is separated from one of the interior channel walls 180 by the channel width 158.

A back wall 182 extends along the width 172 of the connector cage 106. The back wall 182 may contact each of the exterior side walls 178, the interior channel walls 180 and the top side 176 of the connector cage 106. In the illustrated embodiment, the back wall 182 is substantially perpendicular to each of the exterior side walls 178, the interior channel walls 180 and the top side 176.

The connector cage 106 includes one or more channels 112. While four channels 112 are shown in the illustrated embodiment, a different number of channels 112 may be included in the connector cage 106. Additionally, while the channels 112 of the connector cage 106 are illustrated as being side-by-side with one another, the channels 112 also may be configured in a ganged or stacked arrangement.

The channels 112 in the connector cage 106 are partially surrounded by a portion of the top side 176, a plurality of the interior channel walls 180 and/or the exterior side walls 178, and a portion of the back wall 182. For example, in the illustrated embodiment, the two outermost channels 112 are each partially surrounded by a portion of the top side 176, one of the exterior side walls 178, one of the interior channel walls 180 and a portion of the back wall 182. The two inner channels 112 are each partially surrounded by a portion of the top side 176, a pair of the interior channel walls 180 and a portion of the back wall 182.

In the illustrated embodiment, the channel width 158 is approximately the same for all of the channels 112 in the connector cage 106. Optionally, the channel width 158 varies for one or more of the channels 112. The channels 112 have a channel height that is the same or approximately the same as the height 174 of the connector cage 106. The channels 112 have a channel length that is the same or approximately the same as the length 170 of the connector cage 106.

Figure 4:
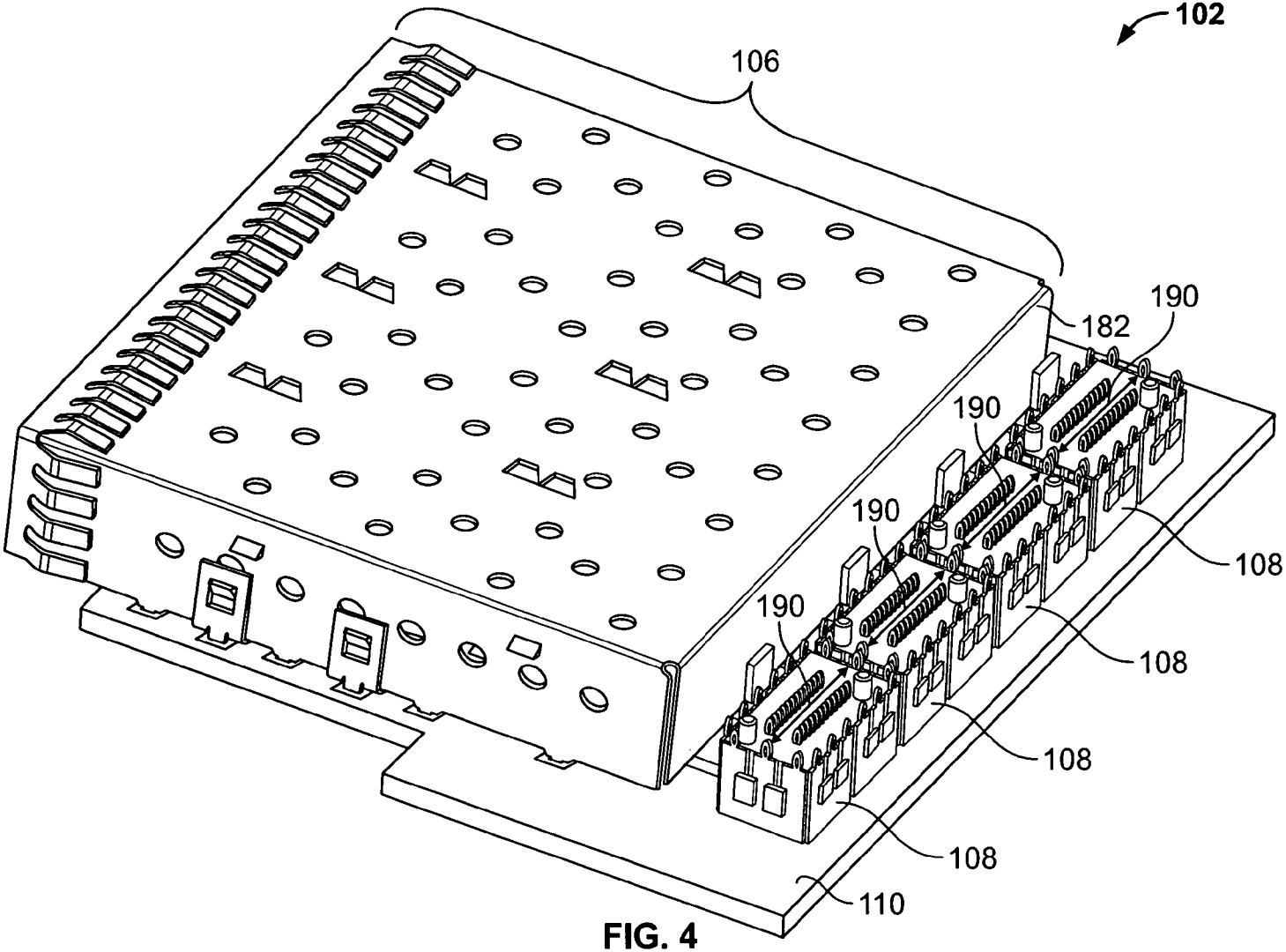
FIG. 4 is a bottom perspective view of the connector assembly of FIG. 1.

FIG. 4 is a bottom perspective view of the connector assembly 102. The jumper assemblies 108 are mounted on the jumper board 110 in a location that is proximate to the back wall 182 of the connector cage 106. Each of the jumper assemblies 108 is elongated along a longitudinal axis 190. In the illustrated embodiment, the jumper assemblies 108 are mounted so that the longitudinal axis 190 of each of the jumper assemblies 108 is substantially parallel to the back wall 182 of the connector cage 106. Alternatively, the juniper assemblies 108 may be mounted on the jumper board 110 so that the longitudinal axis 190 of each jumper assembly 108 may be substantially perpendicular to the back wall 182 of the connector cage 106. For example, the jumper assemblies 108 are mounted on the jumper board 110 so that the longitudinal axis 190 of each jumper assembly 108 is substantially parallel to the exterior side walls 178 of the connector cage 106.

Figure 5:
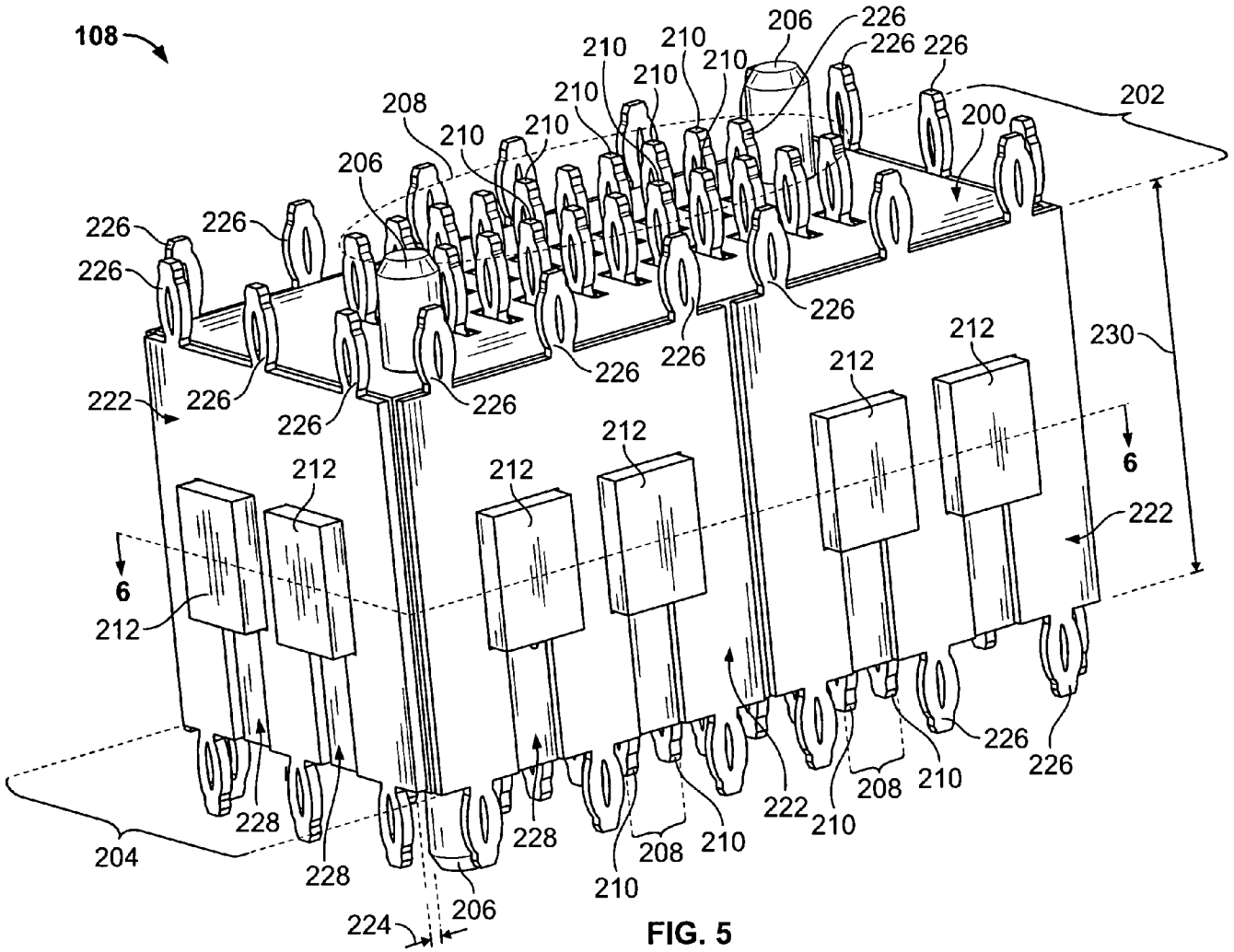
FIG. 5 is a perspective view of the jumper assembly 108 of FIG. 1.

FIG. 5 is a perspective view of the jumper assembly 108. The jumper assembly 108 includes a nonconductive body 200 that extends between a jumper side 202 and a host side 204. The body 200 may be formed from a dielectric or insulating material, such as a plastic material. The jumper and host sides 202, 204 of the body 200 oppose one another and are separated from one another by a jumper height 230. The jumper side 202 of the body 200 engages the jumper board 110 (shown in FIG. 1) when the jumper assembly 108 is mounted on the jumper board 110. The host side 204 of the body 200 engages the host board 118 (shown in FIG. 1) when the jumper assembly 108 engages the host board 118 to interconnect the jumper and host boards 110, 118.

A plurality of alignment pins 206 extend outward from the body 200. The alignment pins 206 protrude from the jumper and host side 202, 204. The alignment pins 206 protruding from the jumper side 202 are inserted into the jumper board 110 to align the jumper assembly 108 on the jumper board 110. The alignment pins 206 protruding from the host side 204 are inserted into the host board 118 to align the jumper assembly 108 and the connector assembly 102 on the host board 118.

A plurality of electrical contacts 208 are held by the body 200. The contacts 208 have compliant tails 210 at opposing ends of each contact 208. The tails 210 protrude from the jumper and host sides 202, 204 of the body 200. The contacts 208 electrically interconnect the jumper and host boards 110, 118 when the jumper assembly 108 is engaged with both the jumper and host boards 110, 118. For example, one end of the tails 210 may be inserted into corresponding holes in the jumper and host boards 110, 118 to electrically interconnect the conductive traces 122, 152 in the jumper and host boards 110, 118 (shown in FIGS. 1 and 2, respectively). The tails 210 may be used to mechanically couple the jumper assemblies 108 to the jumper and host boards 110, 118. In another embodiment, solder may be used to electrically and mechanically couple the contacts 208 to the jumper and host boards 110, 118.

A plurality of shield retention tabs 212 extend outward from the body 200. The shield retention tabs 212 extend outward from one or more of the sides 214, 216, 218, 220 (shown in FIG. 6) of the body 200. The shield retention tabs 212 secure a plurality of shield plates 222 to the body 200.

The shield plates 222 surround at least a portion of the body 200 to shield the contacts 208 from and/or reduce the effects of interference, such as electromagnetic interference. The shield plates 222 may be provided as a single shield. The shield plates 222 are provided along one or more of the sides 214, 216, 218, 220 of the body 200. The shield plates 222 have a thickness 224.

Each of the shield plates 222 includes one or more grounding pins 226. The grounding pins 226 extend from the shield plates 222 in locations that are proximate to the jumper and host sides 202, 204 of the body 200. The grounding pins 226 are inserted into and/or grounded to the jumper board 110 when the jumper assembly 108 is mounted on the jumper board 110. The grounding pins 226 also are inserted into and/or grounded to the host board 118 when the jumper assembly 108 engages the host board 118.

In the illustrated embodiment, each of the shield plates 222 also includes one or more retention slots 228. The shield retention tabs 212 are received within the retention slots 228 to secure the shield plates 222 to the body 200. In an example embodiment, the retention slots 228 extend to an end of the shield plates 222. The shield plates 222 may be loaded onto the body 200 by sliding the retention slots 228 over the shield retention tabs 212, for example.

Figure 6:
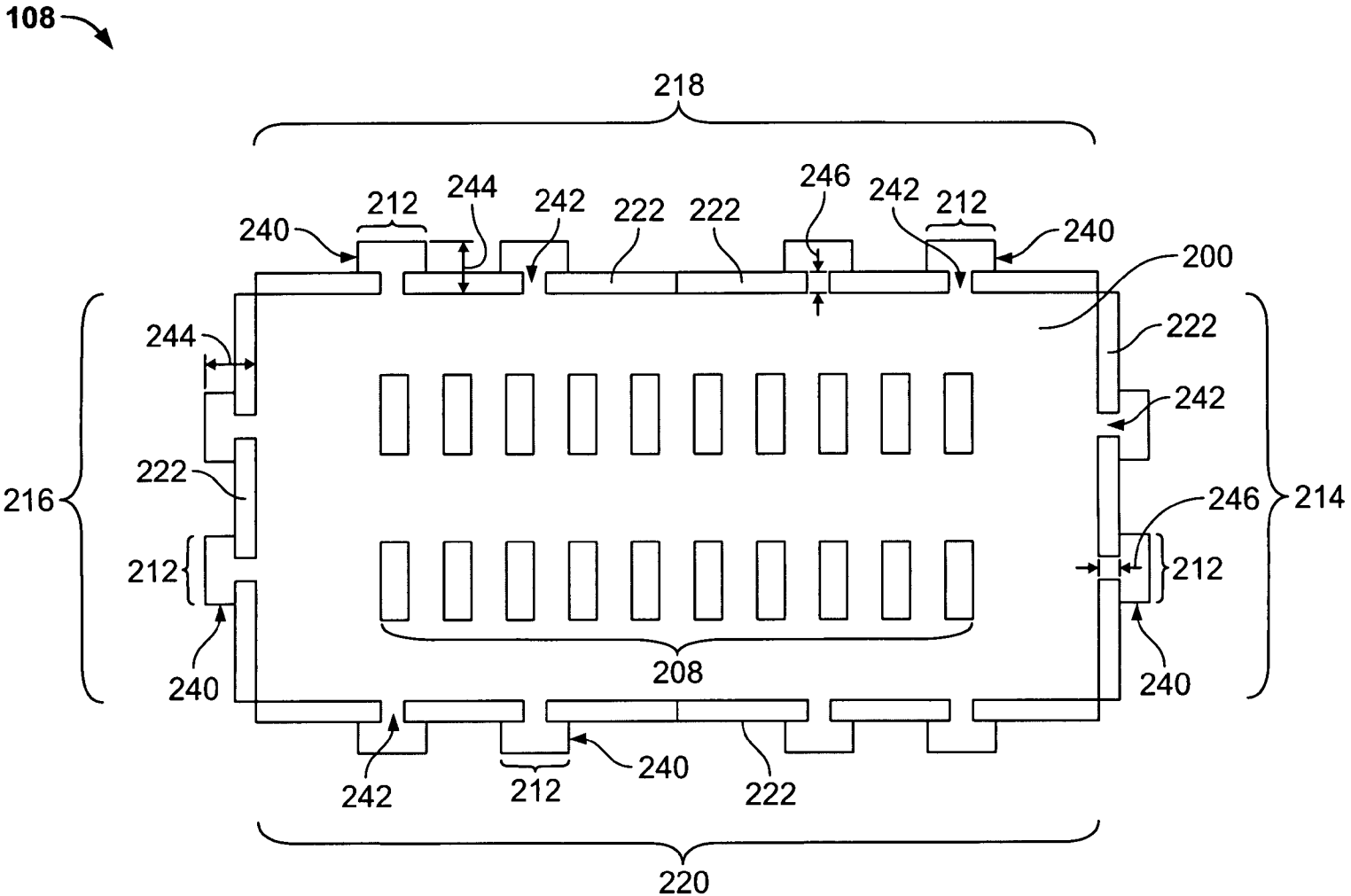
FIG. 6 is a cross-sectional view of the jumper assembly taken along line 6-6 shown in FIG. 5.

FIG. 6 is a cross-sectional view of the jumper assembly 108 taken along line 6-6 shown in FIG. 5. In the illustrated embodiment, the shield retention tabs 212 extend outward from each of the sides 214, 216, 218, 220 of the body 170. In one embodiment, each of the shield retention tabs 212 includes a head portion 240 and a neck portion 242 that extend from the body 200. The head portion 240 extends away from the body 200 a first distance 244. The neck portion 242 extends away from the body 200 a second distance 246. In one embodiment, the second distance 246 is approximately equal to, or slightly greater than, the thickness 224 of the shield plates 222 (shown in FIG. 5) to accommodate the shield plates 222 when mounted to the body 200.

The head portion 240 is wider than the neck portion 242 the width of the shield retention slots 228 (shown in FIG. 5) in the shield plates 222. The width of the neck portion 242 is approximately the same, or slightly smaller than, the width of the shield retention slots 228.

The shield plates 222 are coupled to the body 200 by loading the shield retention slots 228 over the neck portions 242. For example, a shield plate 222 may be slid along one of the sides 214, 216, 218, 220 of the body 200 so that the shield retention slot 228 receives the neck portion 242 of a shield retention tab 212. As the width of the head portions 240 is wider than the shield retention slots 228, the head portions 240 secure the shield plates 222 to the body 200.

Figure 7:
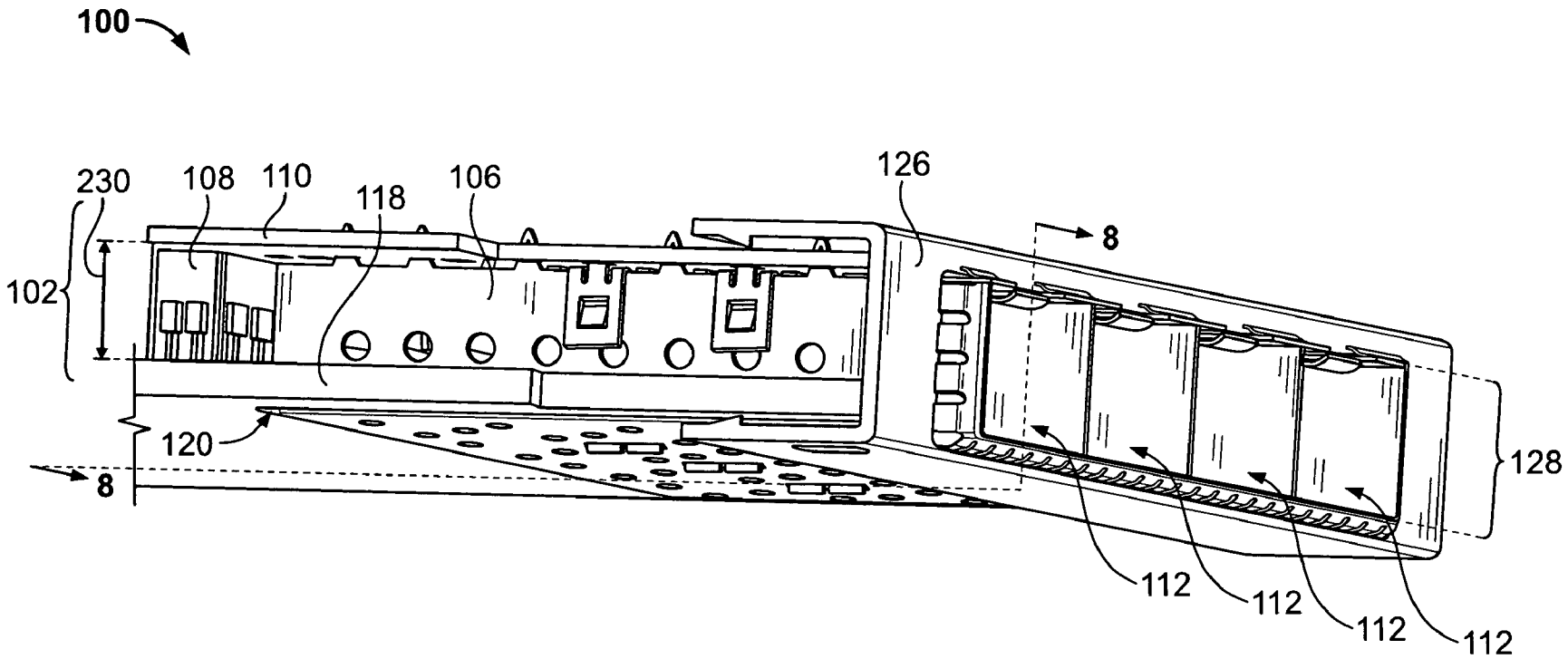
FIG. 7 is a partial cut away perspective view of the interconnect system of FIG. 1.

FIG. 7 is a partial cut away perspective view of the interconnect system 100. The jumper and host boards 110, 118 are interconnected with one another by the jumper assemblies 108. The jumper and host boards 110, 118 are separated by the jumper height 230. In one embodiment, the connector cage 106 partially protrudes through the opening 120 in the host board 118. The alignment pins 206, the tails 210 of the contacts 208 and the grounding pins 226 (shown in FIG. 5) of the jumper assemblies 108 are inserted into corresponding holes in the jumper and host boards 110, 118. For example, the alignment pins 206, the tails 210, and the grounding pins 226 that extend from the jumper side 202 (shown in FIG. 5) of each of the jumper assemblies 108 are inserted into corresponding holes (not shown) in the jumper board 110. The alignment pins 206, the tails 210 and the grounding pins 226 that extend from the host side 204 (shown in FIG. 5) of the jumper assemblies 108 are inserted into corresponding holes in the sets of holes 124 in the host board 118. As such, the connector assembly 102 may be positioned with respect to the host board 118, the face plate 126 and/or the port 128.

The jumper assemblies 108 are used to electrically interconnect the jumper and host boards 110, 118. Each of the jumper assemblies 108 closes a circuit that includes a connector receptacle 114 (shown in FIG. 2), one or more conductive traces 152 (shown in FIG. 2) in the jumper board 110, and one or more conductive traces 122 (shown in FIG. 1) in the host board 118. Once assembled, the plug end of an electrical connector (not shown) may be inserted into one of the channels 112 and mated with the mating interface 146 (shown in FIG. 2) of a connector receptacle 114. The circuit that is closed by one or more of the jumper assemblies 108 permits communication between the electrical connector and the conductive traces 122 in the host board 118.

Different embodiments may include different sizes of the connector cages 106 and/or the connector receptacles 114. For example, different connector cages 106 and/or connector receptacles 114 having industry standard sizes and dimensions may be included in the interconnect system 100. Due to these different sizes and dimensions, the distance between the jumper and host boards 110, 118 may need to be adjusted to align the connector cage 108 and/or the mating interfaces 146 of the connector receptacles 114 with the port 128 of the face plate 126. In an example embodiment, different jumper assemblies 108 having different dimensions, including different jumper heights 230, may be provided in order to align connector receptacles 114 and/or connector cages 106 having different dimensions with the port 128 in the face plate 126. The jumper assemblies 108 having the appropriate dimensions may then be selected for use with a particular connector receptacle 114 and/or connector cage 106.

Figure 8:
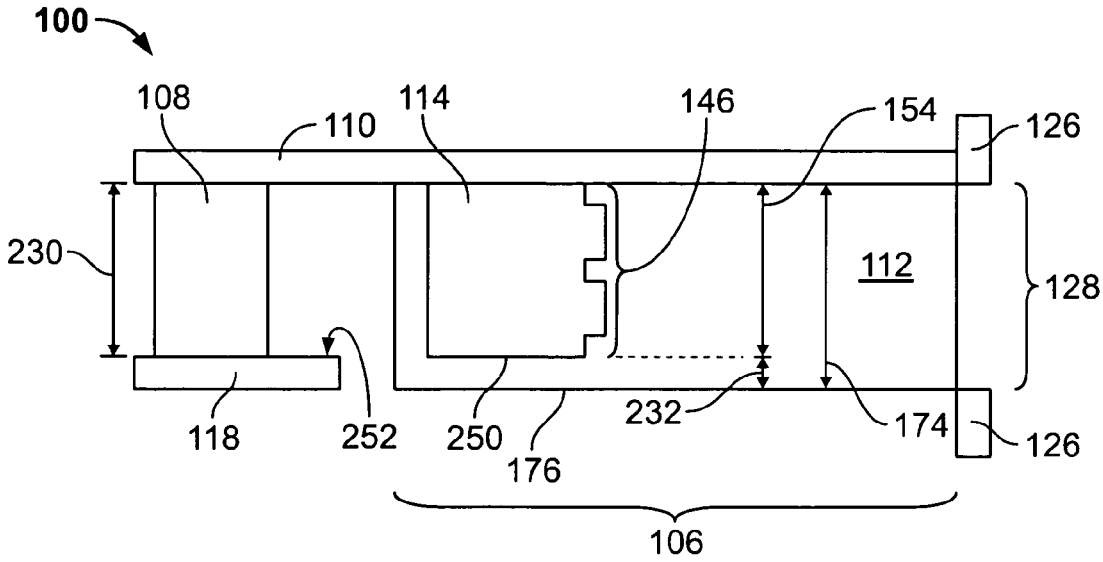
FIG. 8 is a cross-sectional view of the interconnect system taken along the line 8-8 shown in FIG. 7.

FIG. 8 is a cross-sectional view of the interconnect system 100 taken along the line 8-8 shown in FIG. 7. The dimensions of different connector receptacles 114 may differ with respect to one another. For example, the height 154 (shown in FIG. 2) of different connector receptacles 114 may differ with respect to one another. The host board 118, the face plate 126 and the port 128 may be fixed in position with respect to one another. As a result, the distance between the jumper and host boards 110, 118 may need to be adjusted in order to align the mating interfaces 146 of the connector receptacles 114 with the port 128. For example, the distance between the jumper and host boards 110, 118 may be adjusted by using a jumper assembly 108 having a different jumper height 230 in order to position a connector receptacle 114 with respect to the host board 118.

For example, as shown in FIG. 8, a first connector receptacle 114 has a first height 154 and is mounted on the jumper board 110. The first connector receptacle 114 is partially enclosed in a first channel 112. The first channel 112 is located within a first connector cage 106 having a first height 174. The mating interface 146 of the first connector receptacle 114 mates with the plug end of an electrical connector (not shown) that is inserted into a first channel 112. The plug end of the electrical connector is inserted into the channel 112 through the port 128 in the face place 126. The face plate 126 may be fixed in position with respect to the host board 118.

In one embodiment, the mating interface 146 of the first connector receptacle 114 may need to be aligned with the port 128 so that the plug end of an electrical connector may be inserted into the channel 112 to mate with the mating interface 146. In order to align the mating interface 146 with the port 128, a first jumper assembly 108 with a first jumper height 230 is provided to separate the jumper and host 110, 118 by a predetermined distance. The first jumper assembly 108 separates the jumper and host boards 110, 118 by the predetermined distance that is the same or approximately the same as the first jumper height 230.

The first jumper height 230 may be related to the height 154 of the first connector receptacle 114. For example, the first jumper height 230 may be approximately the same as the sum of the height 154 of the first connector receptacle 114 and a first alignment distance 232. The first alignment distance 232 may be a distance between the top 250 of the first connector receptacle 114 and the top wall 176 of a first connector cage 106, for example. The first alignment distance 232 may be necessary to properly align the plug end of an electrical connector with the mating interface 146 of the first connector receptacle 114.

Alternatively, the first jumper height 230 may be proportional to the height 154 of the first connector receptacle 114. For example, the first jumper height 230 may be a percentage of the height 154. By way of example only, the first jumper height 230 may be 125% of the height 154.

In another embodiment, the first jumper height 230 may be based on the distance between the first connector receptacle 114 and the host board 118. For example, the first jumper height 230 may be selected in order to position the top 250 of the first connector receptacle 114 a predetermined distance from a top surface 252 of the host board 118.

Figure 9:
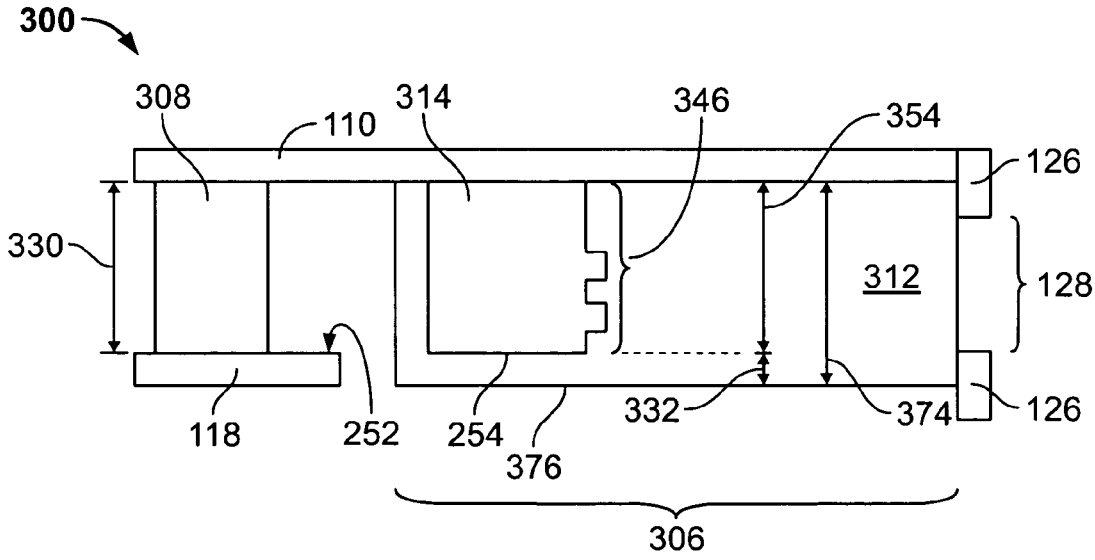
FIG. 9 is a cross-sectional view of an alternative interconnect system.

FIG. 9 is a cross-sectional view of an alternative interconnect system 300. The cross-sectional view of FIG. 9 is similar to the one of FIG. 8, however, the size dimensions and/or orientation of the various components of the interconnect system 300 are different than those illustrated with the interconnect system 100 shown in FIG. 7.

A second connector receptacle 314 in the interconnect system 300 differs from the first connector receptacle 114 in FIG. 8. The height 354 of the second connector receptacle 314 is greater than the height 154 of the first connector receptacle 114. Additionally, a mating interface 346 of the second connector receptacle 314 may be different from the mating interface 146 of the first connector receptacle 114. The second connector receptacle 314 may be configured to engage with a different plug end of an electrical connector (not shown) than the first connector receptacle 114, for example.

In order to align the mating interface 346 with the port 128, the jumper and host boards 110, 118 may need to be separated a greater distance than the first jumper height 230 shown in FIG. 8. In order to separate the jumper and host boards 110, 108 a greater distance, a second jumper assembly 308 with a second jumper height 330 is used to interconnect the jumper and host boards 110, 118. The second jumper height 330 may position the mating interface 346 a predetermined distance away from the host board 118. In another example, the second jumper height 330 may be based on a predetermined distance between a top 254 of the second connector receptacle 314 and the top surface 252 of the host board 118.

The second jumper height 330 may be related to the height 354 of the second connector receptacle 314. For example, the second jumper height 330 may be approximately the same as the sum of the height 354 of the second connector receptacle 314 and a second alignment distance 332. The second alignment distance 332 may be a distance between the top 254 of the second connector receptacle 314 and the top wall 376 of a second connector cage 306, for example. The second alignment distance 332 may be necessary to properly align the plug end of an electrical connector with the mating interface 346 of the second connector receptacle 314.

Alternatively, the second jumper height 330 may be proportional to the height 354 of the second connector receptacle 314. For example, the second jumper height 330 may be a percentage of the height 354. By way of example only, the second jumper height 330 may be 125% of the height 354.

In another embodiment, the second jumper height 330 may be based on the distance between the second connector receptacle 314 and the host board 118. For example, the second jumper height 330 may be selected in order to position the top 254 of the second connector receptacle 314 a predetermined distance from a top surface 252 of the host board 118.

In another example, the height 174 (shown in FIG. 3) of different connector cages 106 also may differ with respect to one another. The separation distance between the jumper and host boards 110, 118 may need to be different for different sized connector cages 106. The separation distance may need to be different in order to align the channels 112 of the different connector cages 106 with the port 128.

For example, as shown in FIG. 8, a first connector cage 106 may have a first height 174. In order to align the first channel 112 in the first connector cage 106 with the port 128, the jumper and host boards 110, 118 may need to be separated by the first jumper height 230. On the other hand, a second connector cage 306 (shown in FIG. 9) may have a second height 374. The second height 374 may be greater than the first height 174.

In order to align the second channel 312 in the second connector cage 306 with the port 128, the jumper and host boards 110, 118 may need to be separated by a greater distance than the first jumper height 230 of the first jumper assembly 108 (shown in FIG. 8). Therefore, a second jumper assembly 308 with a greater jumper height 330 is used to interconnect the jumper and host boards 110, 118. The increased jumper height 330 of the second jumper assembly 308 aligns the second channel 312 with the port 128.

By adjusting the jumper height 230 of the jumper assemblies 108 to change the amount of separation between the jumper and host boards 110, 118, various industry standard-sized connector receptacles 114 and connector cages 106 having different sizes and dimensions may be aligned with respect to the port 128. Additionally, the jumper assemblies 108 having the proper jumper height 230 for aligning the mating interfaces 146 of different sized connector receptacles 114 with the port 128 may be selected from a group of jumper assemblies 108 having various heights 230. In another example, the jumper assemblies 108 having the proper jumper height 230 for aligning different connector cages 106 having different heights 174 may be selected from a group of different sized jumper assemblies 108. Industry standard-sized electrical receptacles 114 and connector cages 106 then may be used in a variety of devices without requiring internal jogs or other assemblies inside the connector cage 106 to ensure that the connector receptacles 114 and the channels 12 are properly aligned with the port 128.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects.

What is claimed is:

1. A connector assembly for a device having a host circuit board, the connector assembly comprising:

a first circuit board comprising a first conductive trace;

a connector receptacle mounted on the first circuit board and electrically connected with the first conductive trace, the connector receptacle comprising a mating interface configured to mate with an electrical connector; and a jumper assembly mounted on the first circuit board and electronically connected with the first conductive trace, the jumper assembly being configured to be mounted to the host circuit board such that the jumper assembly and the connector receptacle are located between the first circuit board and the host circuit board, wherein the jumper assembly controls a position of the connector receptacle with respect to the host circuit board and electrically interconnects the first circuit board, the host circuit board and the connector receptacle.

2. The connector assembly according to claim 1, wherein the jumper assembly controls the position of the connector receptacle with respect to a faceplate mounted on the host circuit board and having a port through which the electrical connector is inserted to mate with the connector receptacle.

3. The connector assembly according to claim 1, further comprising a connector cage having a channel configured to receive the electrical connector, the connector receptacle being disposed within the channel.

4. The connector assembly according to claim 1, further comprising a connector cage having a channel partially enclosing the connector receptacle, the jumper assembly being mounted on the first circuit board in a location that is proximate to a back wall of the connector cage.

5. The connector assembly according to claim 1, wherein the jumper assembly comprises a dielectric body, the body holding a plurality of electrical contacts, the contacts being electrically connected to the first and second conductive traces when the jumper assembly is mounted to the first and host circuit boards.

6. The connector assembly according to claim 1, wherein the jumper assembly comprises contacts configured to electrically couple the first circuit board with the host circuit board and alignment pins configured to align the jumper assembly with respect to the first circuit board and the host circuit board.

7. The connector assembly according to claim 1, wherein the connector assembly comprises a plurality of the jumper assemblies and a plurality of the connector receptacles, each of the jumper assemblies electrically connected to one of the connector receptacles.

8. The connector assembly according to claim 1, wherein the jumper assembly comprises shield plates separated from one another and a plurality of tabs, the shield plates secured to the jumper assembly by receiving the tabs in a slots of the shield plates.

9. A jumper assembly configured to mechanically and electrically interconnect a jumper circuit board with a host circuit board in order to align an electrical connector receptacle mounted on the jumper circuit board with a port in a faceplate mounted on the host circuit board, the jumper assembly comprising:

a dielectric body extending between a host side and a jumper side, the body having a height between the host side and the jumper side; and contacts held within the body and configured to be mechanically and electrically connected to the host circuit board and the jumper circuit board, wherein the body extends between the jumper and host circuit boards to define a separation distance between the jumper and host circuit boards when the connector receptacle is located between the jumper and host circuit boards in order to align the connector receptacle with the port.

10. The jumper assembly according to claim 9, wherein the height of the dielectric body is selected based on the separation distance in order to align a mating interface of the connector receptacle with the port.

11. The jumper assembly according to claim 9, wherein the separation distance is based on a location of a mating interface of the connector receptacle with respect to the port, the mating interface being aligned with the port when the jumper and host circuit boards are separated by the separation distance.

12. The jumper assembly according to claim 9, wherein the separation distance is based on a distance between the connector receptacle and a connector cage mounted on the jumper circuit board, the connector receptacle being partially enclosed by the connector cage.

13. The jumper assembly according to claim 9, further comprising a plurality of alignment pins extending from opposing sides of the body, the alignment pins configured to align the body with each of the jumper and host circuit boards.

14. The jumper assembly according to claim 9, wherein the body includes tabs extending from the body in directions transverse to the height of the body, and further comprising contacts held in the body and shield plates configured to shield the contacts from electromagnetic interference, wherein the shield plates are secured to the body by receiving the tabs in slots of the shield plates.

15. A connector assembly configured to electrically interconnect an electric connector receptacle with a host circuit board, the connector assembly comprising:

a first circuit board electrically interconnected with the host circuit board, the connector receptacle being mounted to the first circuit board; and a jumper assembly having a dielectric body holding electrical contacts, the jumper assembly interconnecting the first and host circuit boards while separating the first and host circuit boards by a jumper height of the jumper assembly such that the connector receptacle is located between the first and host circuit boards and aligned with a faceplate mounted on the host circuit board.

16. The connector assembly of claim 15, wherein the jumper height separates the first and host circuit boards so that a mating interface of the electrical connector receptacle is aligned with a port in the faceplate.

17. The connector assembly of claim 15, wherein the jumper height is selected so that the connector receptacle is separated from the host circuit board by a predetermined distance.

18. The connector assembly of claim 15, wherein the jumper height is approximately a sum of a height of the connector receptacle and a predetermined separation distance between the connector receptacle and a top wall of a connector cage that partially encloses the connector receptacle.

19. The connector assembly of claim 15, further comprising a connector cage having at least one channel, the connector receptacle mounted on the first circuit board and partially enclosed by the connector cage, wherein the jumper height is selected such that the channel is aligned with a port in the faceplate.

20. The connector assembly of claim 19, wherein the jumper assembly closes a circuit that comprises the connector receptacle, a first conductive trace in the first circuit board between the connector receptacle and the jumper assembly, and a second conductive trace in the host circuit board.

* * * * *